US009176449B2

(12) United States Patent
Sato

(10) Patent No.: US 9,176,449 B2
(45) Date of Patent: Nov. 3, 2015

(54) WET-TYPE IMAGE FORMING APPARATUS

(71) Applicant: Konica Minolta, Inc., Chiyoda-ku (JP)

(72) Inventor: Yuuya Sato, Settsu (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/027,879

(22) Filed: Sep. 16, 2013

(65) Prior Publication Data

US 2014/0079420 A1 Mar. 20, 2014

(30) Foreign Application Priority Data

Sep. 18, 2012 (JP) ..... 2012-204498

(51) Int. Cl.
*G03G 15/00* (2006.01)
*G03G 15/10* (2006.01)

(52) U.S. Cl.
CPC ..... *G03G 15/55* (2013.01); *G03G 15/10* (2013.01); *G03G 15/5041* (2013.01)

(58) Field of Classification Search
CPC G03G 15/105; G03G 15/0827; G03G 15/085
USPC ..... 399/57, 74
See application file for complete search history.

(56) References Cited

U.S. PATENT DOCUMENTS 4,799,082 A * 1/1989 Suzuki ..... 399/41
5,162,874 A * 11/1992 Butler ..... 399/74

FOREIGN PATENT DOCUMENTS

| | | | |
|---|---|---|---|
| JP | 3-111743 | A | 5/1991 |
| JP | 4-243283 | A | 8/1992 |
| JP | 6-027823 | A | 2/1994 |
| JP | 2003-091129 | A | 3/2003 |
| JP | 2004-157180 | A | 6/2004 |

* cited by examiner

*Primary Examiner* — Walter L Lindsay, Jr.
*Assistant Examiner* — Ruth Labombard
(74) *Attorney, Agent, or Firm* — Buchanan Ingersoll & Rooney PC

(57) ABSTRACT

A wet-type image forming apparatus includes an image carrier, a toner developer layer, and a toner amount detection unit. The toner amount detection unit includes a light-emitting unit and a light-receiving unit. The wavelength characteristics of a light emission intensity of the light-emitting unit and light reception sensitivity of the toner amount detection unit are set such that an intensity of detection sensitivity of the toner amount detection unit in accordance with a product of a light emission intensity of the light-emitting unit and light reception sensitivity of the light-receiving unit is greater in a wavelength region in which a characteristic value based on a product of a transmittance of the toner developer layer and a reflectivity of the image carrier as a reference for an emission light wavelength is included in a predetermined range, than in other wavelength regions.

5 Claims, 17 Drawing Sheets

FIG.7

| CARRIER LIQUID | MANUFACTURER | REFRACTIVE INDEX n |
|---|---|---|
| IsoperL | Exxon Mobil Corporation | 1.427 |
| IP2028 | IDEMITSU KOSAN CO., LTD. | 1.438 |
| SILICONE OIL | Momentive Performance Materials Inc | 1.397~1.404 |
| SOYBEAN OIL | — | 1.471~1.475 |

WET-TYPE IMAGE FORMING APPARATUS

This application is based on Japanese Patent Application No. 2012-204498 filed with the Japan Patent Office on Sep. 18, 2012, the entire content of which is hereby incorporated by reference.

BACKGROUND OF THE INVENTION

1. Field of the Invention

The present invention relates to an electrophotographic image forming technique for printers, copier, facsimiles, etc., and more particularly to an electrophotographic image forming technique using wet-type development as a development method and a toner amount detection sensor.

2. Description of the Related Art

In electrophotographic image forming apparatuses, a toner image on a photoconductor is developed by toner using a development device. For example, an electrostatic latent image developed on the photoconductor is then transferred onto recording paper to form an image. In such a transfer process of the image forming apparatus, an electrostatic transfer method is generally adopted.

When a toner image is transferred onto a sheet of paper that is a transfer destination, voltage is applied, for example, by a transfer roller from the back surface of paper arranged to be opposed to the photoconductor, so that an electric field is formed between the photoconductor and the recording paper. The electric field causes the toner image to electrostatically adsorb on the recording paper.

A fixing device then fixes the transferred toner image on the recording paper by pressing and heating the toner image.

In recent years, wet-type development devices are known among image forming apparatuses such as office printers for bulk print and on-demand printers that require higher image quality and higher resolution. The wet-type development devices use a liquid developer that has a small toner particle size and is less likely to cause variations in toner images. The wet-type development devices are advantageous in that high-resolution images are obtained because of the toner mean particle size as small as 0.1 to 2 μm, and that uniform images are obtained because of high flowability of liquid.

In the wet-type image forming apparatus, image quality such as image density can be adjusted by changing image forming conditions including various factors such as a bias voltage applied to each unit of the apparatus. The image density of toner images may vary due to individual differences of apparatuses, changes over time, and changes in environment surrounding the apparatus such as temperature and humidity.

In this respect, a density control technique has been proposed which controls an image density by adjusting an image forming condition that affects image density, among the factors as described above.

For example, Japanese Laid-Open Patent Publication No. 2004-157180 proposes a technique in which a patch image for test is formed on a surface of an image carrier, light is applied to the patch image, light from the patch image is received to detect an image density, and image forming conditions such as a surface potential of a photoconductor and a toner density of a developer are controlled based on the detection result.

In the case of color development, the optimum wavelength of light for detecting an image density varies among colors. Japanese Laid-Open Patent Publication No. 3-111743 discloses a density detection device configured such that a light-emitting device corresponding to each color is provided.

Japanese Laid-Open Patent Publication No. 6-27823 proposes a densitometer in which light of a wavelength absorbed in a pigment is emitted.

FIG. 17 shows the result of sensing a toner amount by applying light of a wavelength absorbed in a pigment of each of cyan and yellow developers.

Referring to FIG. 17, the cyan developer is a developer in which toner particles including cyan pigments are dispersed in a carrier liquid.

Here, a red LED is used for the cyan developer. The red LED emits light of a wavelength around 632 nm, where the wavelength of 632 nm is the peak of emission intensity. Light of a wavelength around 632 nm is red light with high absorbance with a cyan pigment.

The horizontal axis represents the toner amount of toner particles included in the developer on an image carrier, and the vertical axis represents a sensor output that is output from a photodiode for use in a light-receiving unit when a developer layer with different toner amounts image density) is detected.

Here, in the figure, the region shown by the dashed lines is a region of a desired toner amount to be detected.

The desired toner amount region includes a target toner amount (toner amount per predetermined area) a on the photoconductor and a toner amount permissible range in the vicinity of the target toner amount.

In order to control the image forming condition based on a sensor output from the toner amount detection sensor, the toner amount detection sensor need to have detection sensitivity in the toner amount permissible range on the image carrier and the toner amount region in the vicinity thereof with the target toner amount a at the center, that is, in the desired toner amount region, and incorporate a difference in toner amount of the developer layer into a difference of the sensor output. It is thus requested that the detection sensitivity should be high in the desired toner amount region.

Referring to the detection result of the toner amount of the cyan developer, the change of the sensor output with respect to the toner amount is great in the desired toner amount region. It can be understood that high detection sensitivity is obtained in the desired toner amount region due to the effect achieved by using an LED of red light with high absorbance with a cyan pigment in the light-emitting unit. In other words, adjustment to the desired toner amount region can be made based on the detection result.

On the other hand, the yellow developer is a developer in which toner particles including yellow pigments are dispersed in a carrier liquid.

Here, a blue LED is used for the yellow developer. The blue LED emits light of a wavelength around 470 nm, where the wavelength of 470 nm is the peak of emission intensity. Light of a wavelength around 470 nm is blue light with high absorbance with a yellow pigment.

Referring to the detection result of the toner amount of the yellow developer, the change of the sensor output with respect to the toner amount is extremely large in a toner amount region smaller than the desired toner amount region. In the desired toner amount region, the sensor output decreases almost to the limit.

Therefore, there is little change in the sensor output with respect to the toner amount in the desired toner amount region. In other words, because of too high detection sensitivity, detection sensitivity cannot be obtained in the desired toner amount region. That is, adjustment to the desired toner amount region is difficult based on the detection result.

Accordingly, when the toner amount detection sensor as described above is used for an image forming apparatus, the sensor cannot output the toner amount on the image carrier accurately in the desired toner amount region, so that it is impossible to properly control an image density (to adjust to the desired toner amount region).

In this respect, the inventor of the present invention conducted a variety of validation experiments about the toner amount detection result of the yellow developer and found that the reason is that the quantity of light received by the light-receiving unit is smaller than expected due to the effects on light given by pigments, specifically, due to the effects of Rayleigh scattering and excessive absorption by pigments.

SUMMARY OF THE INVENTION

The present invention is made in view of the problem that in a detection sensor for the toner amount on a wet-type electrophotographic image carrier, the quantity of received light is reduced due to Rayleigh scattering and excessive absorption by pigments, and detection sensitivity cannot be obtained in a desired toner amount region.

A wet-type image forming apparatus according to an aspect of the present invention includes an image carrier, a toner developer layer formed of toner and a carrier liquid carried on the image carrier, and a toner amount detection unit for detecting a toner amount of the toner developer layer carried on the image carrier. The toner amount detection unit includes a light-emitting unit for emitting light to the toner developer layer carried on the image carrier and a light-receiving unit for receiving reflected light when light is emitted from the light-emitting unit to the toner developer layer carried on the image carrier. Wavelength characteristics of a light emission intensity of the light-emitting unit and a light reception sensitivity of the light-receiving unit are set such that an intensity of detection sensitivity of the toner amount detection unit in accordance with a product of a light emission intensity of the light-emitting unit and a light reception sensitivity of the light-receiving unit is greater in a wavelength region in which a characteristic value based on a product of a transmittance of the toner developer layer and a reflectivity of the image carrier as a reference for a light emission wavelength is included in a predetermined range, than in other wavelength regions.

Preferably, the wavelength region included in a predetermined range corresponds to the wavelength region in which the characteristic value is included in a range of 0.02 to 0.06.

Specifically, the wavelength characteristics of the light emission intensity of the light-emitting unit and the light reception sensitivity of the light-receiving unit are set such that the intensity of detection sensitivity of the toner amount detection unit in the wavelength region in which the characteristic value is included in the range of 0.02 to 0.06 is higher than the intensity of detection sensitivity in the wavelength region in which the characteristic value is included in a range lower than 0.02 or the characteristic value is included in a range greater than 0.06.

Specifically, the wavelength characteristics of the light emission intensity of the light-emitting unit and the light reception sensitivity of the light-receiving unit are set such that the intensity of detection sensitivity of the toner amount detection unit in the wavelength region in which the characteristic value is included in the range of 0.02 to 0.06 is greater than the intensity of the sum of detection sensitivity in the other wavelength regions.

Preferably, the reflectivity of the image carrier is a reflectivity based on specular reflection.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 7 is a diagram illustrating examples of carrier liquid and refractive indices of the carrier liquids.

DESCRIPTION OF THE PREFERRED EMBODIMENTS

Figure 1:
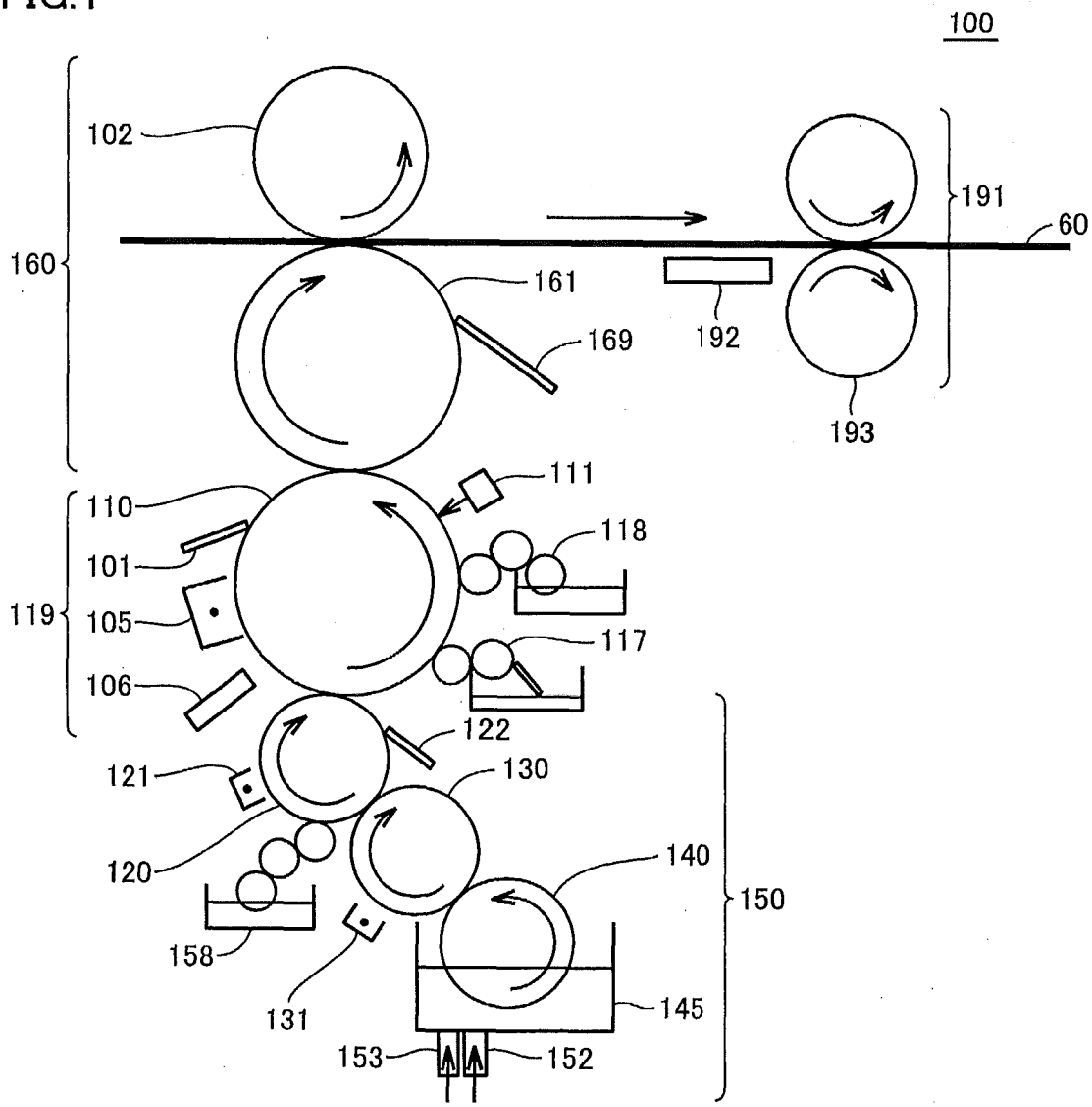
FIG. 1 is a diagram schematically showing an overall configuration of a wet-type image forming apparatus 100.

Embodiments of the present invention will be described below with reference to the figures. In the following description, the same parts and components are denoted with the same reference characters. Their names and functions are also the same.

(Wet-Type Image Forming Apparatus 100)

Figure 2:
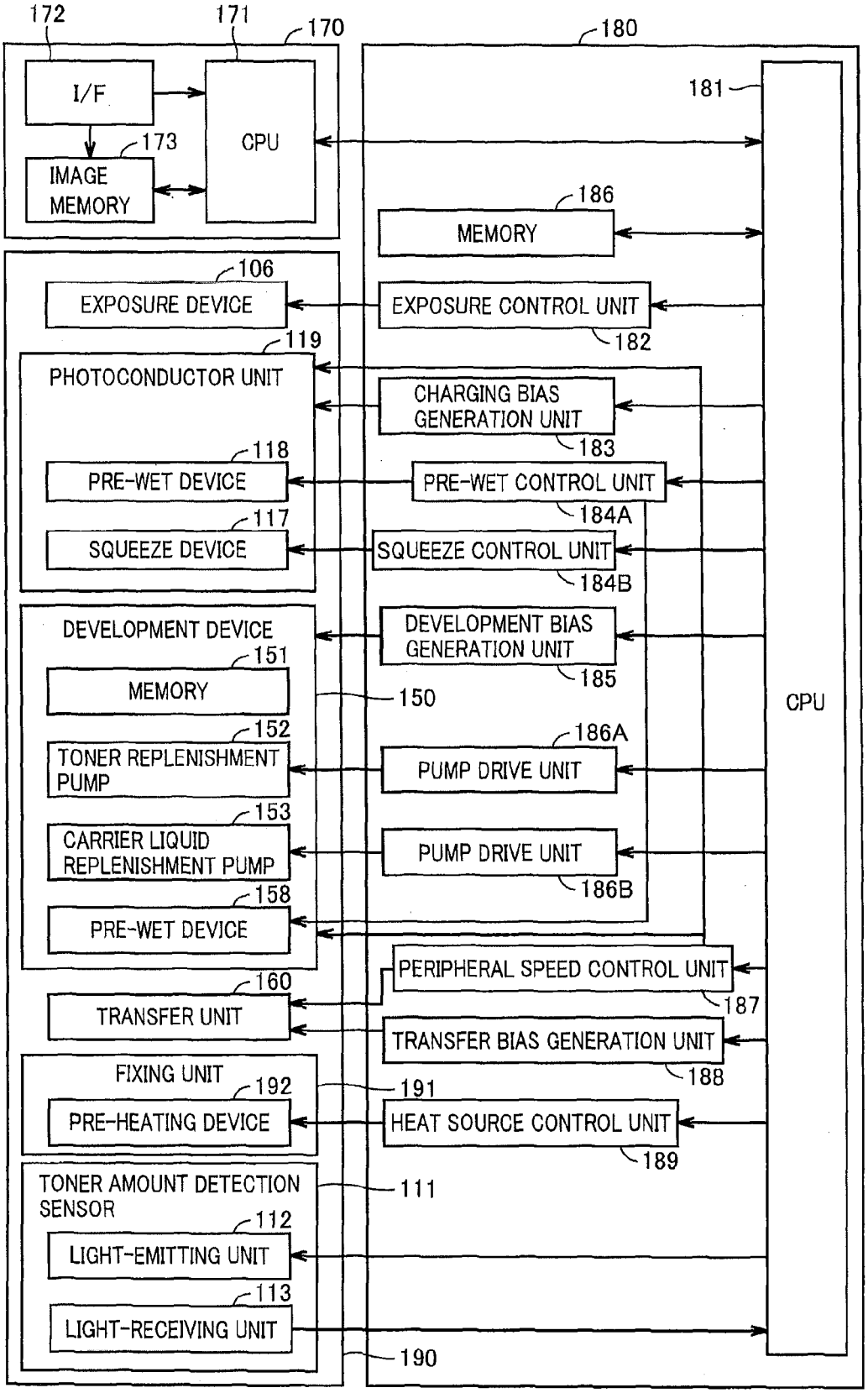
FIG. 2 is a block diagram showing an electrical configuration of wet-type image forming apparatus 100.

Referring to FIG. 1 and FIG. 2, a wet-type image forming apparatus 100 is described.

FIG. 1 is a diagram schematically showing an overall configuration of wet-type image forming apparatus 100.

FIG. 2 is a block diagram showing an electrical configuration of wet-type image forming apparatus 100.

As shown in FIG. 1, wet-type image forming apparatus 100 forms an image on recording paper 60. Recording paper 60 in the present embodiment is conveyed between an intermediate transfer roller 161 (detailed later) and a pressing roller 102 (detailed later) in a predetermined conveyance direction.

As shown in FIG. 2, in wet-type image forming apparatus 100, a print command signal including an image signal is applied to a main control unit 170 from an external device such as a host computer. Main control unit 170 includes an image memory 173. Image memory 173 stores the image signal applied from the external device through an interface 172.

A CPU (Central Processing Unit) 171 receives the print command signal including the image signal from the external device through interface 172 and then converts the print command signal into job data in a format adapted to an operation instruction to an engine unit 190 for output to an engine control unit 180 (control unit).

A memory 186 in engine control unit 180 is configured with a ROM for storing a control program for a CPU 181 including preset fixed data or a RAM for temporarily storing control data for engine unit 190 and an operation result by CPU 181. A program for executing an image forming condition setting mode process (see FIG. 5) is also stored in memory 186. CPU 181 stores data concerning the image signal sent from the external device through CPU 171 into memory 186.

Engine control unit 180 controls each unit in engine unit 190 in response to a control signal from main control unit 170. Wet-type image forming apparatus 100 forms an image corresponding to the image signal, for example, on recording paper 60 (see FIG. 1) with a predetermined image forming condition being set.

Referring to FIG. 1 and FIG. 2, engine unit 190 (see FIG. 2) includes an exposure device 106, a photoconductor unit 119, a development device 150, a transfer unit 160, a fixing unit 191, and a toner amount detection sensor 111.

(Development Device 150)

As shown in FIG. 1, development device 150 includes a development tank 145 for storing a developer W, a supply roller 140, a delivery roller 130, a charger 131, a development roller 120, a charger 121, and a pre-wet device 158. A memory 151 (see FIG. 2) of development device 150 stores data concerning the production lot of development device 150, use history, the characteristics of built-in toner, and the level of developer W or the toner density of developer W. A variety of information such as consumables for development device 150 is managed by memory 151.

In development device 150, developer W is stored in development tank 145. Developer W mainly contains an insulating liquid that is a carrier liquid, toner for developing an electrostatic latent image, and a dispersant for dispersing toner in the carrier liquid. A toner replenishment pump 152 and a carrier liquid replenishment pump 153 are each connected to development tank 145. Toner replenishment pump 152 is driven by a pump drive unit 186A (see FIG. 2) to supply high-density developer W into development tank 145. Carrier liquid replenishment pump 153 is driven by a pump drive unit 186B (see FIG. 2) to supply the carrier liquid into development tank 145.

For example, when pump drive unit 186A is controlled, for example, by the image forming condition setting mode process (see FIG. 5) as described later to drive toner replenishment pump 152, the high-density developer is supplied into development tank 145 to increase the toner density of developer W. On the other hand, when pump drive unit 186B is controlled, for example, by the image forming condition setting mode process (see FIG. 5) as described later to drive carrier liquid replenishment pump 153, the carrier liquid is supplied into development tank 145 to reduce the toner density of developer W. In this way, the toner density of developer W in development tank 145 can be adjusted appropriately through the operation control of pump drive units 186A and 186B.

Supply roller 140 is provided in contact with developer W in development tank 145. Supply roller 140 rotates in the arrow direction whereby developer W is drawn onto the surface of supply roller 140. Developer W is carried on the surface of supply roller 140. With rotation of supply roller 140, developer W is conveyed toward the place where supply roller 140 and delivery roller 130 are opposed to each other.

Developer W on the surface of supply roller 140 is passed from supply roller 140 to delivery roller 130 while an excessive amount thereof is scraped off by a doctor blade (not shown). Developer W is carried on the surface of delivery roller 130 and electrified with predetermined electric charges by charger 131. Delivery roller 130 rotates in the arrow direction whereby developer W is conveyed to the place where delivery roller 130 and development roller 120 are opposed to each other.

Developer W on the surface of delivery roller 130 is passed from delivery roller 130 to development roller 120. Developer W left on the surface of delivery roller 130 is removed from the surface of delivery roller 130 by a cleaning blade (not shown). Development roller 120 rotates in the arrow direction. Developer W is carried on the surface of development roller 120 and conveyed toward a development position by rotation of development roller 120.

Pre-wet device 158 has rollers arranged to be opposed to development roller 120 and is controlled, for example, by the image forming condition setting mode process (see FIG. 5) described later to supply the carrier liquid (pre-wet liquid) to a developer layer on development roller 120. For example, when the toner density of the developer layer on development roller 120 is high, a pre-wet control unit 184A (see FIG. 2) drives pre-wet device 158. The carrier liquid is supplied to the developer layer on development roller 120 through the rollers to reduce the toner density of the developer layer on development roller 120.

Through the process as described above, developer W adjusted to have a uniform film thickness in the longitudinal direction is carried on the surface of development roller 120. Developer W forms a thin film on the surface of development roller 120. Toner particles in developer W forming a thin film are charged to, for example, the positive polarity by charger 121. A predetermined development bias is applied to development roller 120 by a development bias generation unit 185 (see FIG. 2).

(Photoconductor Unit 119)

Photoconductor unit 119 mainly includes a photoconductor 110, a charger 105, a pre-wet device 118, a squeeze device 117, and a cleaning blade 101. The drum-like photoconductor 110 that is an image carrier is provided in contact with development roller 120. For example, an amorphous silicon photoconductor to be positively charged is used as photoconductor 110. Photoconductor 110 rotates in the arrow direction.

On the periphery of photoconductor 110, charger 105, exposure device 106, development roller 120 described above (development position), squeeze device 117, pre-wet device 118, toner amount detection sensor 111, intermediate transfer roller 161, cleaning blade 101, and a neutralizer (not shown) are arranged in this order along the rotational direction (arrow direction) of photoconductor 110.

The surface of photoconductor 110 is uniformly charged to a predetermined surface potential by charger 105 connected to a charging bias generation unit 183 (see FIG. 2). The surface of photoconductor 110 is thereafter exposed by exposure device 106 connected to an exposure control unit 182 (see FIG. 2) based on predetermined image information.

More specifically, a print command signal including an image signal is applied to CPU 171 of main control unit 170 through interface 172 from an external device such as a host computer. In response to a command from CPU 171 of main control unit 170, CPU 181 outputs a control signal corresponding to the image signal to exposure control unit 182 at a predetermined timing. In response to a control command from exposure control unit 182, exposure device 106 applies a light beam to the surface of photoconductor 110. The surface of photoconductor 110 is exposed, so that an electrostatic latent image corresponding to the image signal is formed on the surface of photoconductor 110.

As described above, a predetermined development bias is applied to development roller 120 (development position) by development bias generation unit 185 (see FIG. 2). An electric field is formed between development roller 120 and photoconductor 110 due to a development potential difference formed between development roller 120 and photoconductor 110.

When an electrostatic latent image is conveyed to the development position on photoconductor 110, toner particles in developer W (developer layer) carried on development roller 120 are electrostatically moved from the surface of development roller 120 to the surface of photoconductor 110 by the action of an electric field formed by development bias generation unit 185 (see FIG. 2). Here, not only the toner particles but also the carrier liquid adheres to the surface of photoconductor 110. The electrostatic latent image formed on the surface of photoconductor 110 becomes visible as a toner image.

Photoconductor 110 carrying the toner image formed on the surface thereof moves the toner image toward a transfer unit (primary transfer unit). Developer W left on development roller 120 without being transferred from development roller 120 to photoconductor 110 is scraped off from the surface of development roller 120 by cleaning blade 122 and then recovered.

Squeeze device 117 has rollers arranged to be opposed to photoconductor 110. Squeeze device 117 is controlled, for example, by the image forming condition setting mode process (see FIG. 5) described later to recover the carrier liquid absorbed from the toner image on photoconductor 110, for example, using a blade. For example, when the amount of carrier liquid in the toner image on photoconductor 110 is larger than necessary, a squeeze control unit 184B (see FIG. 2) drives squeeze device 117. The carrier liquid is recovered from the toner image on photoconductor 110 through the rollers whereby the amount of carrier liquid in the toner image on photoconductor 110 can be reduced.

Pre-wet device 118 has rollers arranged to be opposed to photoconductor 110. Pre-wet device 118 is controlled, for example, by the image forming condition setting mode process (see FIG. 5) described later to supply the carrier liquid (pre-wet liquid) to the toner image on photoconductor 110. For example, when the amount of carrier liquid in the toner image on photoconductor 110 is not enough, pre-wet control unit 184A (see FIG. 2) drives pre-wet device 118. The carrier liquid is supplied to the toner image on photoconductor 110 through the rollers thereby to increase the amount of carrier liquid in the toner image on photoconductor 110.

(Toner Amount Detection Sensor 111)

Toner amount detection sensor 111 is arranged downstream from the development position on the surface of photoconductor 110 and upstream from the transfer unit. Toner amount detection sensor 111 detects an image density (toner amount in the toner image) carried on the surface of photoconductor 110 before transfer to intermediate transfer roller 161.

Figure 3:
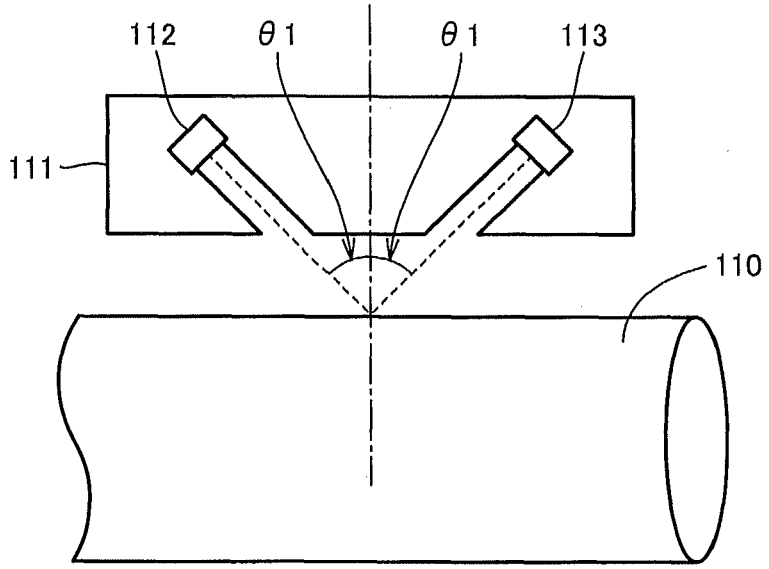
FIG. 3 is a perspective view schematically showing a toner amount detection sensor 111.

FIG. 3 is a perspective view showing toner amount detection sensor 111.

As shown in FIG. 3, toner amount detection sensor 111 is a reflection-type optical sensor. Toner amount detection sensor 111 includes a light-emitting unit 112 formed with an LED (Light Emitting Diode) and a light-receiving unit 113 formed with a photodiode.

The inclination angle of the optical axis of light-emitting unit 112 with respect to the normal to the surface of photoconductor 110 is set at an angle θ1. The inclination angle of the optical axis of light-receiving unit 113 with respect to the normal to the surface of photoconductor 110 is also set to an angle θ1. Light-emitting unit 112 and light-receiving unit 113 are disposed at the bottom of narrow holes formed along their respective optical axes in a casing.

Detection light is applied from light-emitting unit 112 toward the toner image carried on the surface of photoconductor 110. The detection light is specularly reflected or is diffusely reflected off the surface of photoconductor 110 and the toner image (patch image) on the surface of photoconductor 110. Reflected light obtained through reflection from the surface of photoconductor 110 and the toner image is received by light-receiving unit 113.

Since the surface of photoconductor 110 is formed flat, the detection light applied to the surface of photoconductor 110 is specularly reflected off the surface of photoconductor 110. With the specular reflection, of the detection light, the quantity of reflected light obtained from the detection light reflected from the surface of photoconductor 110 is larger.

On the other hand, toner in the toner image carried on the surface of photoconductor 110 forms irregularities on the surface of photoconductor 110. Of the detection light, the detection light applied to the irregularities is diffusely reflected off the surface of toner (irregularities). With the diffuse reflection, of the detection light, the quantity of reflected light obtained from the detection light reflected from the surface of toner is smaller. Accordingly, the quantity of reflected light is smaller at a part of the surface of photoconductor 110 that is covered with toner (the part where the image density of the toner image is high), whereas the quantity of reflected light is larger at a part of the surface of the photoconductor 110 that is not covered with toner (the part where the image density of the toner image is low).

Figure 4:
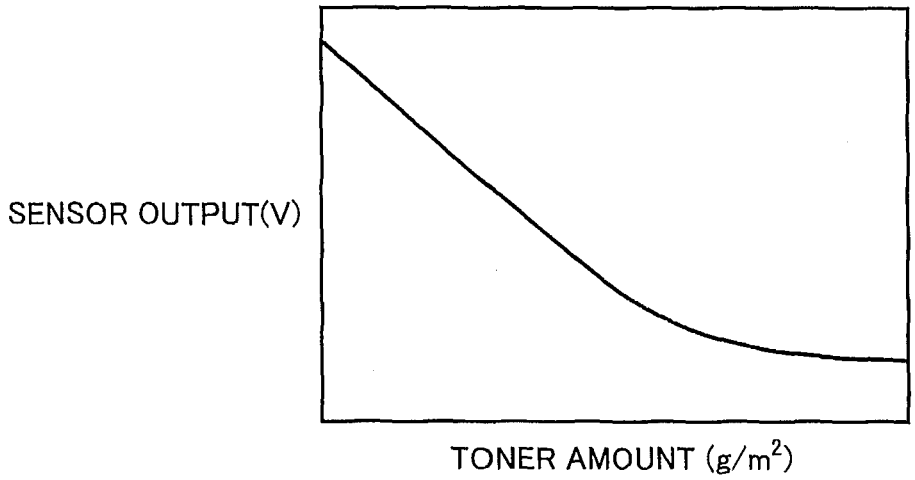
FIG. 4 is a graph showing an example schematically showing the relationship between sensor output and toner amount.

FIG. 4 is a graph showing an example schematically showing the relationship between sensor output and toner amount.

Referring to FIG. 4, when the toner amount on the image carrier increases, the exposed area of the bare surface of the image carrier decreases and the received light output reduces. The toner amount of the developer layer on the image carrier can be detected by detecting the received light output for the developer layer.

The light reception result (the toner amount in the toner image) obtained by light-receiving unit 113 is sent as a received light output to CPU 181 (see FIG. 2). The relationship between the received light output from light receiving unit 113 and the toner amount (image density) is stored beforehand, for example, in memory 186 (see FIG. 2) as a reference table A that can be invoked.

CPU 181 (see FIG. 2) compares the intensity of the reflected light (received light output) detected by light-receiving unit 113 with reference table A thereby to calculate the toner amount in the toner image (patch image) and the image density of the toner image. As will be detailed later, wet-type image forming apparatus 100 (see FIG. 1 and FIG. 2) is set in a predetermined image forming condition in accordance with the image density of the toner image as calculated by CPU 181.

(Transfer Unit 160)

Referring to FIG. 1 and FIG. 2 again, transfer unit 160 mainly includes an intermediate transfer roller 161 (see FIG. 1). Intermediate transfer roller 161 is arranged to be opposed to photoconductor 110. Intermediate transfer roller 161 rotates in the arrow direction. A transfer section is formed between photoconductor 110 and intermediate transfer roller 161. A transfer bias generation unit 188 (see FIG. 2) applies a predetermined transfer bias to form an electric field between intermediate transfer roller 161 and photoconductor 110.

The toner image carried on photoconductor 110 and conveyed to the transfer section is primary-transferred from the surface of photoconductor 110 onto the surface of intermediate transfer roller 161 by the action of the electric field. Toner left on the surface of photoconductor 110 without being primary-transferred and contamination on the surface of photoconductor 110 are scraped off from the surface of photoconductor 110 by cleaning blade 101 and then recovered. Electric charges left on the surface of photoconductor 110 is removed by a neutralizer (not shown).

A transfer section (secondary transfer section) is formed between intermediate transfer roller 161 and pressing roller 102. Intermediate transfer roller 161 rotating in the arrow direction and pressing roller 102 rotating in the arrow direction allow recording paper 60 to pass through the transfer section along the conveyance direction.

After the toner image is primary-transferred from the surface of photoconductor 110 onto the surface of intermediate transfer roller 161 at the transfer section, intermediate transfer roller 161 carrying the toner image transferred on the surface thereof further moves the toner image toward the transfer section. Transfer bias generation unit 188 (see FIG. 2) applies a predetermined transfer bias to form an electric field between intermediate transfer roller 161 and recording paper 60.

The toner image carried by intermediate transfer roller 161 and conveyed to the transfer section is secondary-transferred from the surface of intermediate transfer roller 161 onto the surface of recording paper 60 by the action of the electric field. The toner left on the surface of intermediate transfer roller 161 without being secondary-transferred and contamination on the surface of intermediate transfer roller 161 are scraped off from the surface of intermediate transfer roller 161 by a cleaning blade 169 and then recovered.

(Fixing Unit 191)

Fixing unit 191 includes a fixing roller 193 and a preheating device 192. Recording paper 60 has the toner image secondary-transferred on the surface thereof and is then sent to fixing unit 191. Toner particles in the toner image transferred on recording paper 60 are heated and pressed by fixing roller 193.

The toner image transferred on recording paper 60 is fixed on the surface of recording paper 60 as a result of the heating and pressing. Recording paper 60 is then discharged to the outside through a paper discharge device (not shown). An image forming process in wet-type image forming apparatus 100 is thus completed. In the configuration described above, development roller 120 and intermediate transfer roller 161 are formed like rollers. However, they may be formed like belts.

Pre-heating device 192 is driven by a heat source control unit 189 (see FIG. 2) as necessary. Pre-heating device 192 is a device that heats recording paper 60 before fixing and can promote volatilization of the carrier liquid absorbed in recording paper 60.

Referring to FIG. 2 again, a program for executing the image forming condition setting mode process (see FIG. 5) described below is stored in memory 186 of engine control unit 180. CPU 181 controls each unit of the apparatus in accordance with the control program to execute the image forming condition setting mode process for setting the image forming condition of wet-type image forming apparatus 100 in a predetermined state.

In the image forming condition setting mode process, light-emitting unit 112 of toner amount detection sensor 111 operates based on a control signal from CPU 181. Light-emitting unit 112 applies detection light toward a toner image (patch image). The light-receiving unit receives reflected light from the toner image, and the received light output corresponding to the amount of received light is sent to CPU 181 for various determination. CPU 181 controls a variety of image forming conditions as necessary and writes the controlled image forming condition into memory 186 to update the image forming condition stored in memory 186. The image forming condition setting mode process will be described in more details below.

(Image Forming Condition Setting Mode Process)

Figure 5:
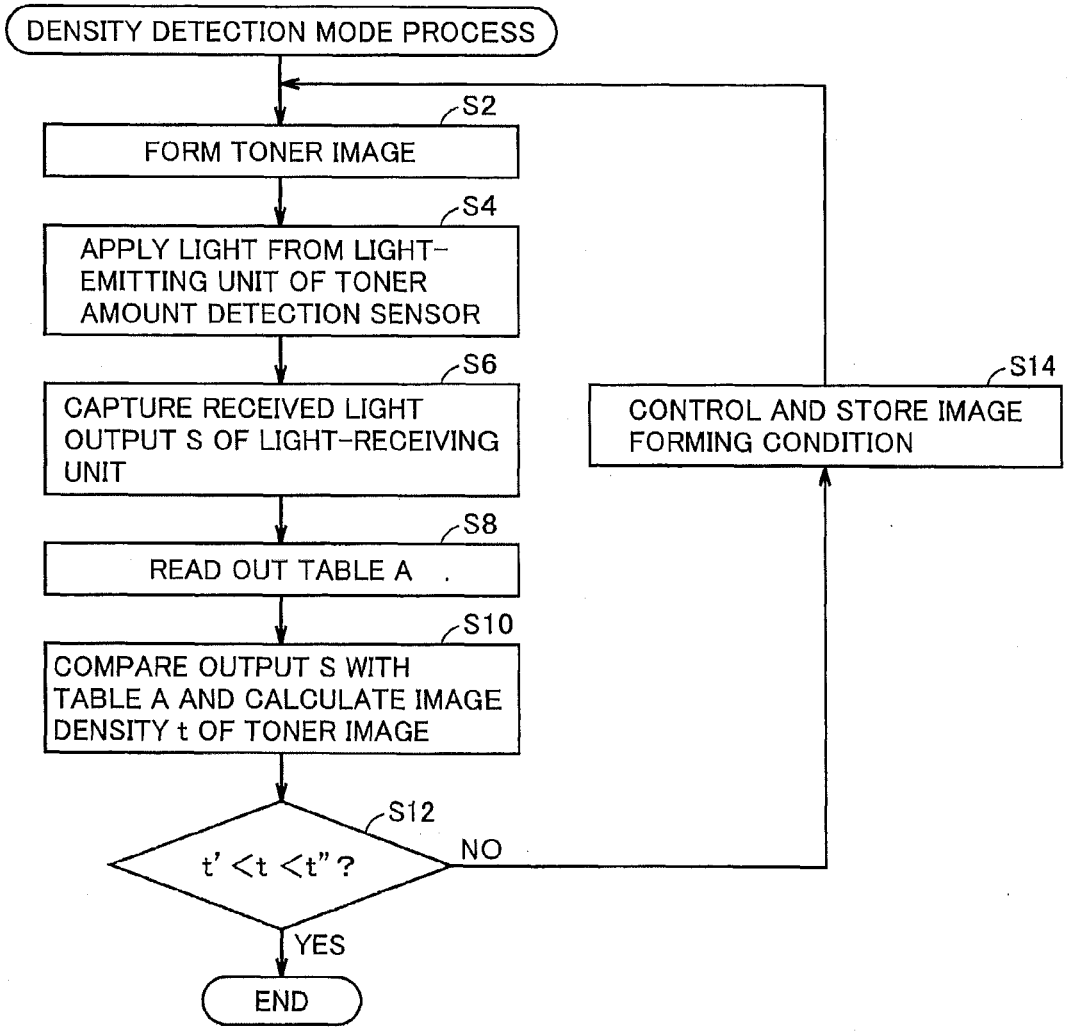
FIG. 5 is a flowchart illustrating an image forming condition setting mode process executed in wet-type image forming apparatus 100.

FIG. 5 is a flowchart illustrating the image forming condition setting mode process executed in wet-type image forming apparatus 100.

Referring to FIG. 5, first, a desired toner image (patch image) to be detected is formed on photoconductor 110 (step S2). With rotation of photoconductor 110, the toner image reaches a detection region of toner amount detection sensor 111. Light-emitting unit 112 of toner amount detection sensor 111 applies detection light toward the toner image (step S4).

Light-receiving unit 113 of toner amount detection sensor 111 detects the intensity of reflected light from the toner image. The light reception result of light-receiving unit 113 is captured as a received light output S by CPU 181 (step S6). CPU 181 reads out the above-noted reference table A stored in memory 186 (step S8). CPU 181 calculates an image density t of the toner image by comparing the received light output S (received light signal) received from light-receiving unit 113 with the value in reference table A (step S10).

CPU 181 determines whether the image density t of the toner image falls within a permissible range t' to t" as the image density of the toner image on photoconductor 110 that is obtained and stored beforehand (step S12). If the image density t of the toner image falls within the permissible range (YES in step S12), CPU 181 terminates the image forming condition setting mode process (END).

On the other hand, if the image density t of the toner image falls outside the permissible range, CPU 181 controls (changes) the image forming condition for storage into memory 186 (step S14). The flow above is repeated until falling in the permissible range.

As the control of the image forming condition, for example, if the image density is not enough ($t \leq t'$), the amount of current applied to charger 121 of development roller 120 is increased to increase the amount of charges of toner particles in developer W carried on development roller 120. An electric field formed between development roller 120 and photoconductor 110 increases an electrical driving force that acts on the toner particles to facilitate movement of the toner particles onto photoconductor 110. This improves the image density of the toner image on photoconductor 110.

If t≤t', a peripheral speed control unit 187 shown in FIG. 2 may accelerate the peripheral speed between supply roller 140 and delivery roller 130 to increase the amount of developer W supplied to development roller 120 per unit time. This can improve the image density of the toner image on photoconductor 110.

On the other hand, if the image density has a value greater than necessary (where t"≤t), the amount of current applied to charger 121 of development roller 120 is reduced to reduce the amount of charges of the toner particles in the developer carried on development roller 120. An electric field formed between development roller 120 and photoconductor 110 reduces an electrical driving force that acts on the toner particles so that the toner less moves onto photoconductor 110. This can reduce the image density of the toner image on photoconductor 110.

If t"≤t, peripheral speed control unit 187 shown in FIG. 2 may decelerate the peripheral speed between supply roller 140 and delivery roller 130 to reduce the amount of developer W supplied to development roller 120 per unit time. This can reduce the image density of the toner image on photoconductor 110.

Otherwise, in order to set the image density t of the toner image within the permissible range (t' to t"), the toner density of developer W may be increased/reduced by driving pump drive unit 186A, 186B, or the amount of liquid squeeze at the nip section (development position) may be increased/reduced by increasing/reducing the abutment force between development roller 120 and photoconductor 110. Wet-type image forming apparatus 100 can be set in a predetermined image forming condition by controlling the image forming condition while detecting the image density of the toner image.

(Setting of Wavelength Characteristic of Sensor)

Figure 6:
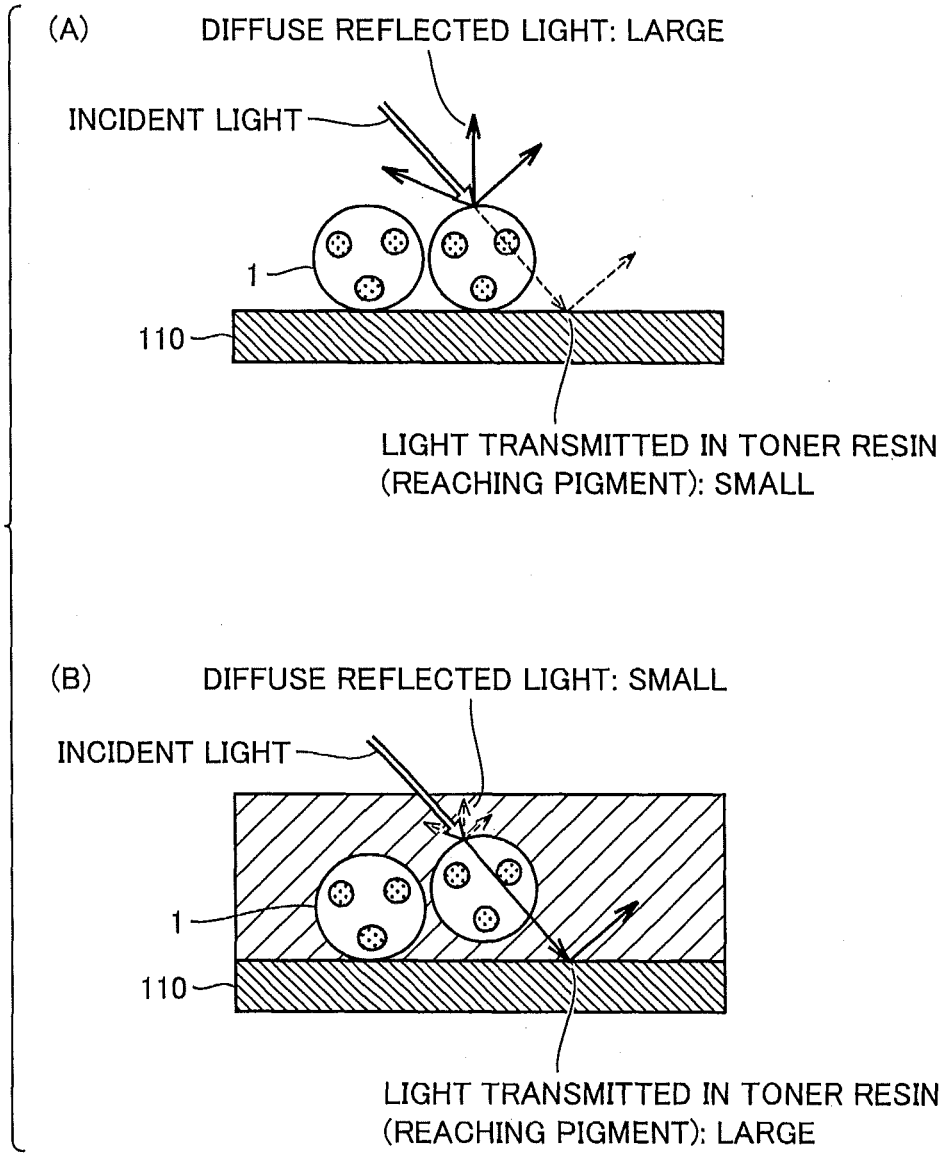
FIG. 6 illustrates the effect of light in a dry type (no carrier liquid) and in a wet type (with carrier liquid).

FIG. 6 illustrates the effect of light in a dry type (no carrier liquid) and in a wet type (with carrier liquid).

Referring to FIG. 6(A), in the case of the dry type (no carrier liquid), incident light from light-emitting unit 112 is transmitted through the air (refractive index n 1) and enters a toner particle. Here, the refractive index n of toner resin 1 forming a toner particle is, in general, approximately 1.5. Since the difference in refractive index between the air and the toner resin is large, the quantity of light transmitted in the toner resin becomes small. In the dry type (no carrier liquid), therefore, the quantity of light reaching a pigment is small, and the reduction of the quantity of received light by the effect of a pigment is small.

Referring to FIG. 6(B), in the case of the wet type (with carrier liquid), incident light from light-emitting unit 112 is transmitted through the air and the carrier liquid and enters a toner particle.

FIG. 7 is a diagram illustrating examples of carrier liquid and refractive indices of the carrier liquids.

Referring to FIG. 7, here, the refractive indices of four kinds of carrier liquid are shown. The refractive index n of a general carrier liquid is approximately 1.4.

Since the difference in refractive index between the carrier liquid and the toner resin is small, the quantity of light transmitted in the toner resin is larger.

In the wet type (with carrier liquid), therefore, the quantity of light reaching a pigment is larger, and the reduction of the quantity of received light by the effect of a pigment, that is, Rayleigh scattering and excessive absorption is significant.

(Rayleigh Scattering)

Rayleigh scattering occurs in a system in which fine particles are dispersed in a liquid, solid, or gas solvent. The scattering intensity of light has wavelength dependence. Short wavelengths of violet to blue are more likely to be scattered (the scattering intensity is high), and the longer wavelengths are less scattered (the scattering intensity is low). Here, since a pigment in a developer is contained in the form of a fine particle in a toner particle, light transmitted in the toner particle is Rayleigh-scattered by the pigment.

When the effect of Rayleigh scattering by the pigment is significant, incident light emitted by light-emitting unit 112 is not only diffusely reflected off the toner particle surface and absorbed in the toner particle and pigment but also scattered by the pigment, so that the quantity of light transmitted through the developer layer and received by light-receiving unit 113 is reduced. In particular, because of the wavelength dependency of Rayleigh scattering, short wavelengths of violet to blue are more likely to be scattered, and the quantity of light received by light-receiving unit 113 is significantly reduced.

In the toner amount detection sensor for a cyan developer as described above, light-emitting unit 112 is an LED that emits red light of a wavelength around 632 nm, which is less likely to be scattered by a pigment, resulting in high detection sensitivity in the desired toner amount region.

On the other hand, in the toner amount detection sensor for a yellow developer, light-emitting unit 112 is an LED that emits blue light of a wavelength around 470 nm, which is more likely to be scattered by a pigment. Therefore, incident light from light-emitting unit 112 is not only absorbed by a pigment but also scattered by a pigment, so that the quantity of light received by light-receiving unit 113 is reduced.

As a result, the sensor output for the toner amount decreases almost to the limit in a toner amount region smaller than the desired toner amount region, and detection sensitivity cannot be obtained in the desired toner amount region.

(Excessive Absorption)

In the detection sensor for the toner amount on the image carrier, when the quantity of light reaching a pigment is large, if the wavelength of light emitted by light-emitting unit 112 is a wavelength at which the absorbance with the pigment included in the developer to be detected is high, incident light from light-emitting unit 112 is mostly absorbed in the pigment. The quantity of light received by light-receiving unit 113 is therefore reduced. Therefore, the sensor output decreases almost to the limit in a toner amount region smaller than the desired toner amount region, and detection sensitivity cannot be obtained in the desired toner amount region.

First Embodiment

In the present embodiment, a wavelength of light that acts on the detection is appropriately selected depending on the pigment included in the developer to be detected. That is, the wavelength characteristic of the sensor is set appropriately.

In this respect, the wavelength characteristic of the sensor is determined by a combination of the wavelength characteristics of the light emission intensity spectrum of the light-emitting unit and the light reception sensitivity spectrum of the light-receiving unit and means the characteristic of detection sensitivity for each wavelength of light of the toner amount detection sensor. In this example, the detection sensitivity is represented by a light emission intensity×light reception sensitivity.

Figure 8:
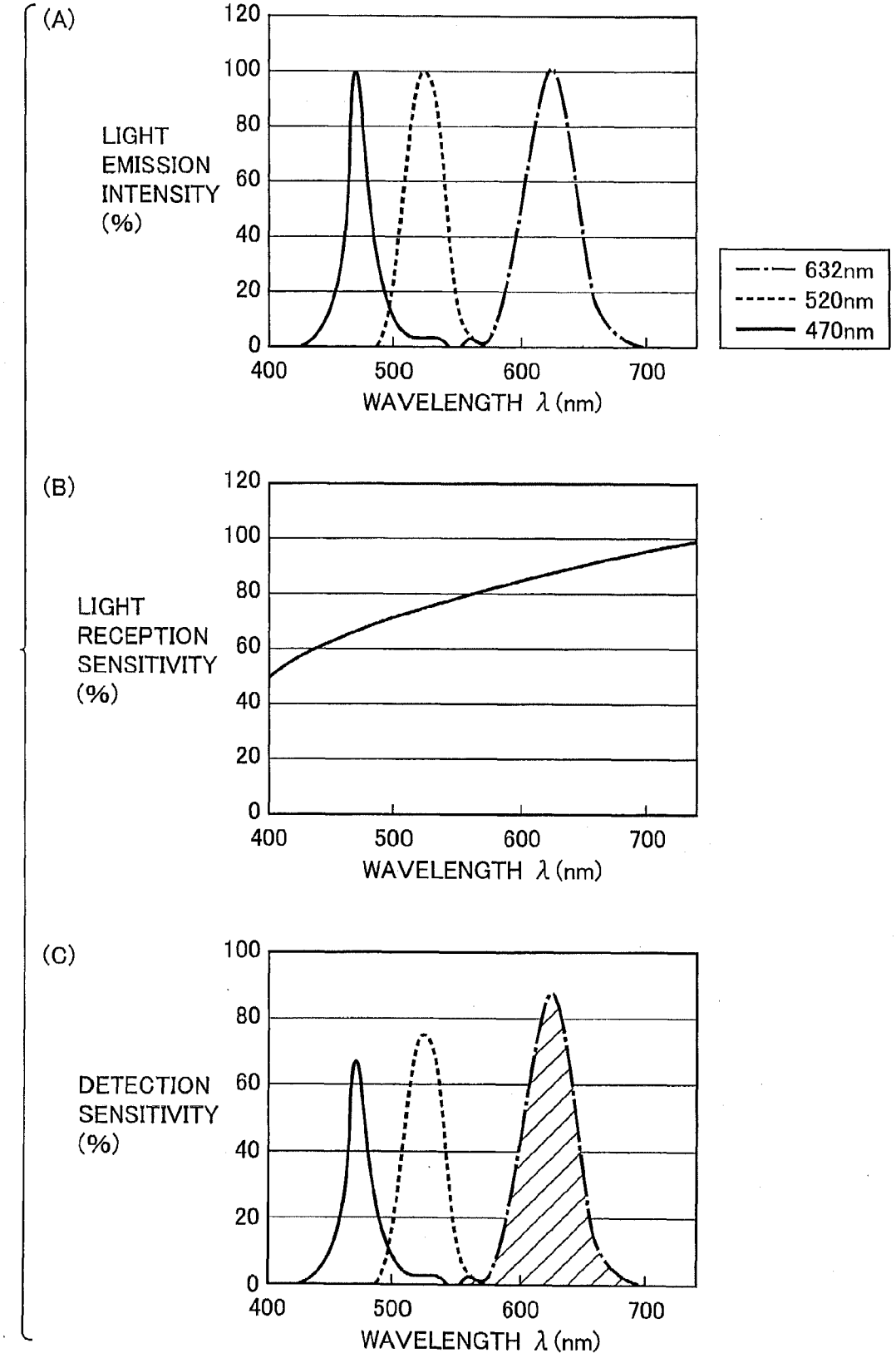
FIG. 8 illustrates the light emission intensity, the light reception intensity, and the detection sensitivity of the sensor according to the present invention.

FIG. 8 illustrates the light emission intensity, the light reception sensitivity, and the detection sensitivity of the sensor according to the present invention.

Referring to FIG. 8(A), here, the light emission intensity spectrum of an LED is shown.

Specifically, the peak wavelength of a red LED is 632 nm. The peak wavelength of a green LED is 520 nm. The peak wavelength of a blue LED is 470 nm.

Referring to FIG. 8(B), here, the light reception sensitivity spectrum of a photodiode as the light-receiving unit is shown. The peak wavelength of the light reception sensitivity of the photodiode in this example is 780 nm.

Referring to FIG. 8(C), the detection sensitivity in this example is shown.

The detection sensitivity in the present embodiment is shown by the product of a light emission intensity and light reception sensitivity as described above.

The sensor intensity (intensity of detection sensitivity) in the present embodiment is shown by an integral value of detection sensitivity with respect to a wavelength region. For example, the sensor intensity (intensity of detection sensitivity) over all the wavelengths of toner amount detection means using an LED of 632 nm corresponds to the hatched region.

In the present embodiment, the wavelength characteristic of the sensor is set using a developer characteristic value based on transmittance T of the developer reflectivity R of the image carrier.

Figure 9:
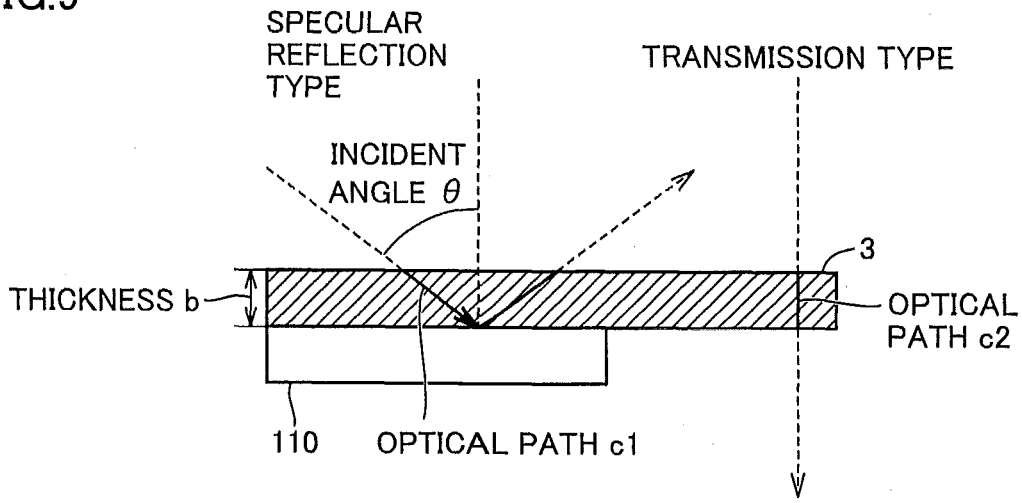
FIG. 9 is a diagram illustrating a toner amount t per area of a diluted developer for use in transmittance measurement.

FIG. 9 is a diagram illustrating a toner amount t per area of a diluted developer for use in transmittance measurement.

Referring to FIG. 9, in the specular reflection-type toner amount detection sensor, light emitted from light-emitting unit 112 is transmitted through developer 3 with an optical path of c1 and specularly reflected off the image carrier (photoconductor 110).

Therefore, if transmittance T of the developer and reflectivity R of the image carrier are measured, the developer characteristic value (T×R) corresponds to the quantity of light received at light-receiving unit 113 for each wavelength when white light with a light emission intensity of 100% for each wavelength is emitted from light-emitting unit 112 to the developer in the specular reflection-type toner amount detection sensor.

Here, in measurement of transmittance T, the following points should be taken into consideration.

Transmittance T of the developer varies depending on the toner density (the number of toner particles) included in the developer. Specifically, the higher is the toner density (the larger is the number of toner particles), the lower is transmittance T.

In the specular reflection-type toner amount detection sensor, light obliquely enters the developer having a thickness b at an incident angle of θ1, is transmitted through the developer layer with an optical path of c1/2, reaches the image carrier, is specularly reflected off the image carrier (photoconductor 110), is transmitted through the developer layer again with an optical path of c1/2, and reaches light-receiving unit 113.

By contrast, in the transmission-type toner amount detection sensor, light enters from immediately above the developer layer at an incident angle of 0°, is transmitted through the developer layer only once with an optical path of c2 (=b), and reaches the light-receiving unit of the toner amount detection sensor. That is, even with the developer layer having the same thickness b and the same toner density, the number of toner particles met by light is larger and transmittance T is lower in the specular reflection type than in the transmission type due to a longer optical path.

Therefore, in order to find transmittance T of the developer in toner amount detection sensor 111 for the developer layer in the image forming apparatus, it is necessary to produce a measurement sample (diluted developer) considering the number of toner particles met by light.

For the measurement sample, the toner amount per predetermined area is set based on the detection result by the transmission-type toner amount detection sensor.

Here, the relationship between optical path c1 in the specular reflection type and optical path c2 in the transmission type is represented by the expressions below.

For the developer layer having thickness b, the optical path c1 in the specular reflection type: $c1=b\times 2/\cos\theta$ the optical path c2 in the transmission type: $c2=b$.

The number of toner particles met by light in the specular reflection type is $2/\cos\theta$ times as large as that in the transmission type, due to a longer optical path.

Here, in this example, the target toner amount on the image carrier in the image forming apparatus is a toner amount a per predetermined area, by way of example.

In this case, given the toner amount t per predetermined area of the diluted developer to be measured by the transmission type, the transmittance corresponds to the transmittance of toner amount $t\cos\theta/2$ per predetermined area in the specular reflection type.

Therefore, given the toner amount $t=2a/\cos\theta$ per predetermined area of the diluted developer to be measured by the transmission type, transmittance T of the developer layer (toner amount a per predetermined area) on the image carrier in the image forming apparatus can be measured, which corresponds to the transmittance in the specular reflection type.

In this example, it has been described that measurement is performed for the measurement sample using the transmission-type toner amount detection sensor. However, in the specular reflection-type toner amount detection sensor, the same toner amount per predetermined area can be set.

It is also necessary to consider the reflection characteristics (reflectivity) of the image carrier to be detected by toner amount detection sensor 111. Specifically, it is necessary to select a photoconductor that reflects light acting on the detection (the reflectivity at a wavelength of light acting on the detection is high).

Toner amount detection sensor 111 receives light that is mirror-reflected (specularly reflected) off the image carrier, of incident light from light-emitting unit 112, at light-receiving unit 113.

If the reflectivity of the image carrier is low for the wavelength at which light-emitting unit 112 has a light emission intensity, the quantity of received light at light-receiving unit 113 is reduced.

Even when the reflectivity of the image carrier is high for the wavelength at which light-emitting unit 112 has a light emission intensity, and the quantity of received light at light-receiving unit 113 is large, if light-receiving unit 113 does not have light reception sensitivity in the wavelength region in which reflectivity is high, the sensor output is reduced.

It is therefore necessary to measure the quantity of received light at light-receiving unit 113, considering not only the relationship between the wavelength characteristic (detection sensitivity) of the sensor and transmittance T of the developer but also reflectivity R of the image carrier.

Here, for measurement of reflectivity R, the following points should be taken into consideration.

Transmittance T of the developer×reflectivity R of the image carrier that is obtained through measurement is a value corresponding to the quantity of received light at light-receiving unit 113 in the specular reflection-type toner amount detection sensor.

It is therefore necessary that reflectivity R should be a reflectivity that corresponds to the quantity of specular reflected light, of the quantity of reflected light from the image carrier.

The measurement modes of a spectrophotometer as a measuring device include a reflectivity measurement mode (SCE mode) and a reflectivity measurement mode (SCI mode). In the SCE mode, the effect of specular reflected light from the measurement sample is removed, and the reflectivity is measured only based on diffuse reflected light. In the SCI mode, the effect of specular reflection from the measurement sample is taken into consideration, and the reflectivity is measured based on the sum of diffuse reflected light and specular reflected light (total reflection).

Accordingly, reflectivity (specular reflection only) R=R1−R2 can be calculated based on reflectivity R2 measured in the SCE mode (diffuse reflection only) from reflectivity R1 measured in the SCI mode (specular reflection+diffuse reflection).

In this example, it has been described that the reflectivity is calculated based on the SCE mode and the SCI mode. However, this method is only by way of example. The reflectivity (specular reflection only) may be calculated using a mode that enables calculation of the reflectivity of only specular reflection, if any.

Next, the developer characteristic value T×R based on the product of transmittance T of the developer and reflectivity R of the image carrier will be described.

Figure 10:
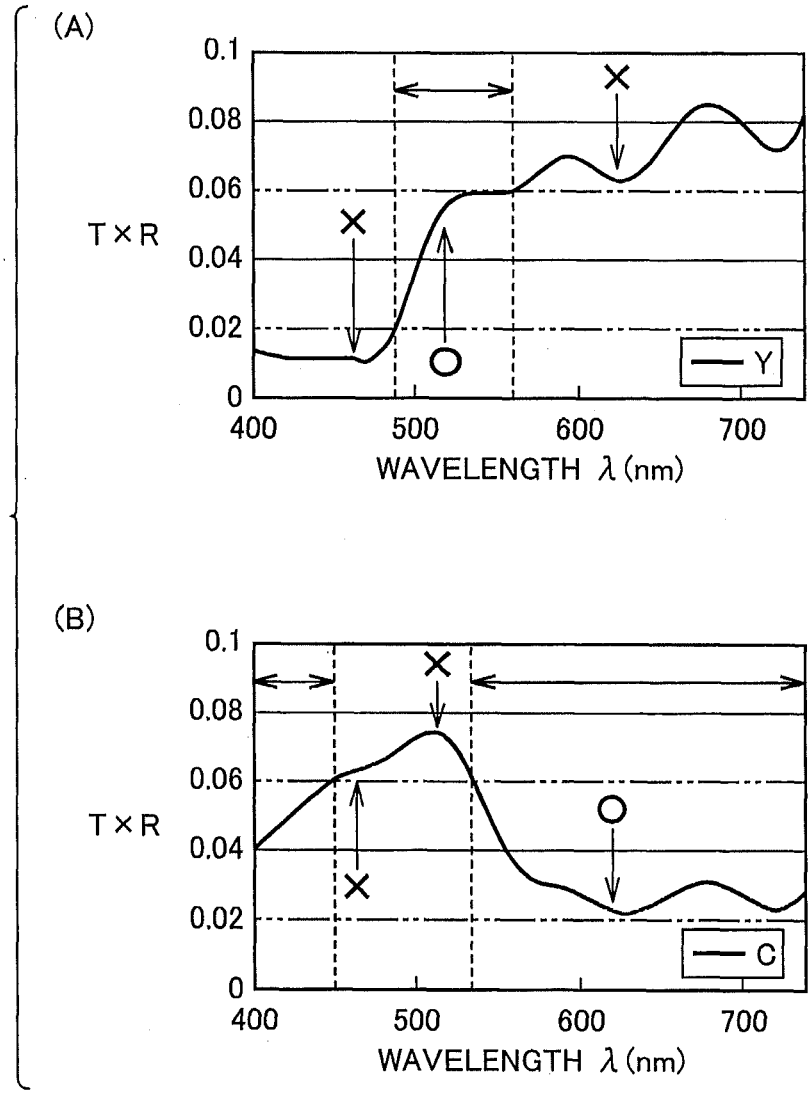
FIG. 10 illustrates the wavelength characteristic of a developer characteristic value (transmittance T×reflectivity R) according to the present embodiment.

FIG. 10 illustrates the wavelength characteristic of the developer characteristic value (transmittance T×reflectivity R) according to the present embodiment.

FIG. 10(A) illustrates the wavelength characteristic of the developer characteristic value (transmittance T×reflectivity R) for a Y diluted developer.

FIG. 10(B) illustrates the wavelength characteristic of the developer characteristic value (transmittance T×reflectivity R) for a C diluted developer.

The toner amount a per predetermined area is 1 g/m$^2$.

Here, a spectrophotometer CM 3700d manufactured by Konica Minolta was used as a toner amount detection sensor.

An a-Si photoconductor was used as a sample for measuring the reflectivity.

A sample container (a thickness b=5.5 mm) was used as a sample for measuring the transmittance.

The measurement result of transmittance T is affected by the particle size (particle size distribution) of toner particles in the diluted developer for use in measurement. Therefore, it is better that the particle size of toner particles used in the diluted developer is closer to the particle size distribution of the developer actually used in the image forming apparatus. It is possible to use a diluted developer having a particle size distribution in which degradation over time in the image forming apparatus is assumed, or a diluted developer that is degraded over time by actually performing image forming operation with the image forming apparatus.

Incident angle θ1 may be a setting center value or a setting target value of the incident angle of light-emitting unit 112 and light-receiving unit 113 of toner amount detection sensor 111 that is set in the image forming apparatus.

A wavelength region in which the developer characteristic value (transmittance T×reflectivity R) is included in a predetermined range is specified.

Specifically, a wavelength region in which the developer characteristic value is included in a range of 0.02 to 0.06 is specified.

For the Y diluted developer, the wavelengths are 490 to 562 nm. The wavelengths are those defined in the range shown by the arrow in FIG. 10(A).

For the C diluted developer, the wavelengths are 400 to 450 nm and 536 to 740 nm. The wavelengths are those defined in the range shown by the arrow in FIG. 10(B).

Within the range in which the developer characteristic value is 0.02 to 0.06, the characteristic exhibited is such that the effect of Rayleigh scattering is small and absorption by pigments is moderate to obtain sensitivity.

Within the range in which the developer characteristic value is less than 0.02, the characteristic exhibited is such that the effect of Rayleigh scattering or excessive absorption or the effects of both result in too high sensitivity.

Within the range in which the developer characteristic value exceeds 0.06, the characteristic exhibited is such that absorption by pigments is not enough, resulting in too low sensitivity.

In this example, it is described that a preferred wavelength region is specified based on transmittance T×reflectivity R as a developer characteristic value. However, a wavelength region may be specified only based on transmittance T.

Figure 11:
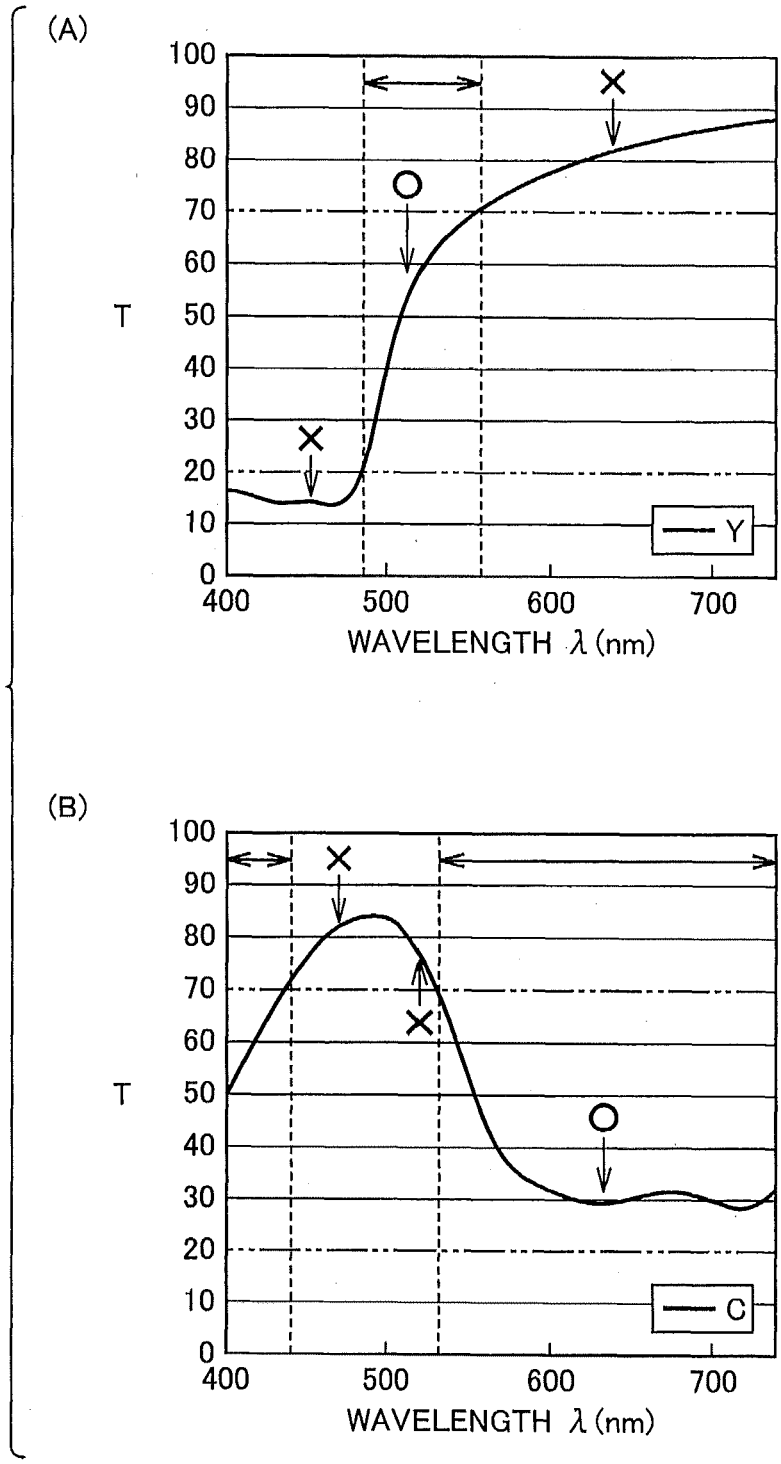
FIG. 11 illustrates the wavelength characteristic of transmittance T.

FIG. 11 illustrates the wavelength characteristic of transmittance T.

FIG. 11(A) illustrates the wavelength characteristic of transmittance T for the Y diluted developer.

FIG. 11(B) illustrates the wavelength characteristic of transmittance T for the C diluted developer.

Specifically, the wavelength region in which transmittance T is included in a predetermined range of 20≤T≤70 is specified.

For the Y diluted developer, the wavelengths are 487 to 562 nm. The wavelengths are those defined in the range shown by the arrow in FIG. 11(A).

For the C diluted developer, the wavelengths are 400 to 442 nm and 533 to 740 nm. The wavelengths are those defined in the range shown by the arrow in FIG. 11(B).

Here, since the value of reflectivity is not included, the developer characteristic value is more accurate.

Similarly, the wavelength region can be specified only based on reflectivity R.

Figure 12:
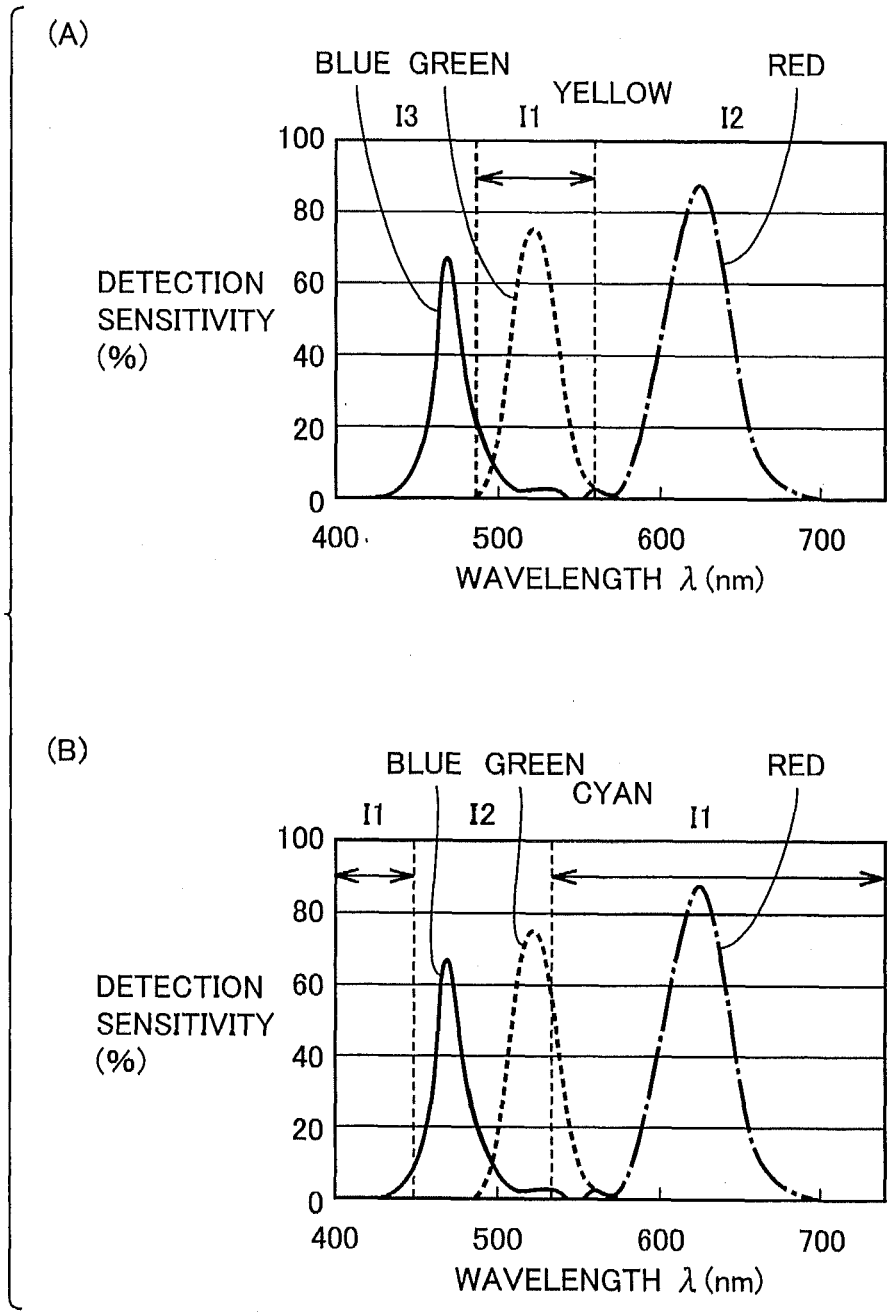
FIG. 12 shows that the optimum emission wavelengths are set based on the wavelength characteristics of detection sensitivity of LEDs of three colors (red, green, and blue).

FIG. 12 shows that the optimum emission wavelength is set based on the wavelength characteristics of detection sensitivity of LEDs of three colors (red, green, and blue).

Referring to FIG. 12, here, the detection sensitivity of LEDs of three colors illustrated in FIG. 8(C) is shown. Specifically, the detection sensitivity is shown based on that the peak wavelength of a red LED as a light-emitting unit is 632 nm and the peak wavelength of a photodiode as a light-receiving unit is 780 nm. Furthermore, the detection sensitivity is shown based on that the peak wavelength of a green LED as a light-emitting unit is 520 nm and the peak wavelength of a photodiode as a light-receiving unit is 780 nm. Furthermore, the detection sensitivity is shown based on that the peak wavelength of a blue LED is 470 nm and the peak wavelength of a photodiode as a light-receiving unit is 780 nm.

Then, the sensor intensity (intensity of detection sensitivity) included in the predetermined range of the developer characteristic value as illustrated in FIG. 10 above is calculated.

Here, it is assumed that the sensor intensity in the wavelength region corresponding to the range in which the developer characteristic value is 0.02 to 0.06 is I1.

It is also assumed that the sensor intensity in the wavelength region corresponding to the range in which the developer characteristic value exceeds 0.06 is I2.

It is also assumed that the sensor intensity in the wavelength region corresponding to the range in which the developer characteristic value is less than 0.02 is I3.

As described above, the sensor intensity (intensity of detection sensitivity) in the present embodiment is represented by the integral value of detection sensitivity with respect to a wavelength region.

In the first embodiment, the toner amount detection sensor is set to have a sensor wavelength characteristic in which sensor intensity I1 is higher than the other sensor intensities I2 and I3. It is further preferable that sensor intensity I1>sensor intensities I2+I3.

(For Yellow (Y) Developer)

The sensor intensities I1 and I3 of the red LED (peak wavelength (632 nm)) are almost zero. Only the sensor intensity I2 has an intensity.

In this case, although the effects of Rayleigh scattering and excessive absorption are small, absorption by a pigment is low, so that sensitivity cannot be obtained in the desired toner amount region.

The sensor intensities I2 and I3 of the green LED (peak wavelength (520 nm)) are almost zero. Only the sensor intensity I1 has an intensity.

The condition that sensor intensities I2+I3<sensor intensity I1 is also satisfied.

The absorbance with a pigment is moderate and the effects of Rayleigh scattering and excessive absorption are small, so that sensitivity can be obtained in the desired toner amount region.

The sensor intensities I1 and I2 of a blue LED (peak wavelength (470 nm)) are almost zero. Only the sensor intensity I3 has an intensity.

In this case, although the absorbance with a pigment is high, sensitivity is too high because of the effects of Rayleigh scattering and excessive absorption, so that sensitivity cannot be obtained in the desired toner amount region.

For the yellow (Y) developer, therefore, a green LED is used as a light-emitting unit to enable detection of the desired toner amount region with more appropriate detection sensitivity.

Figure 13:
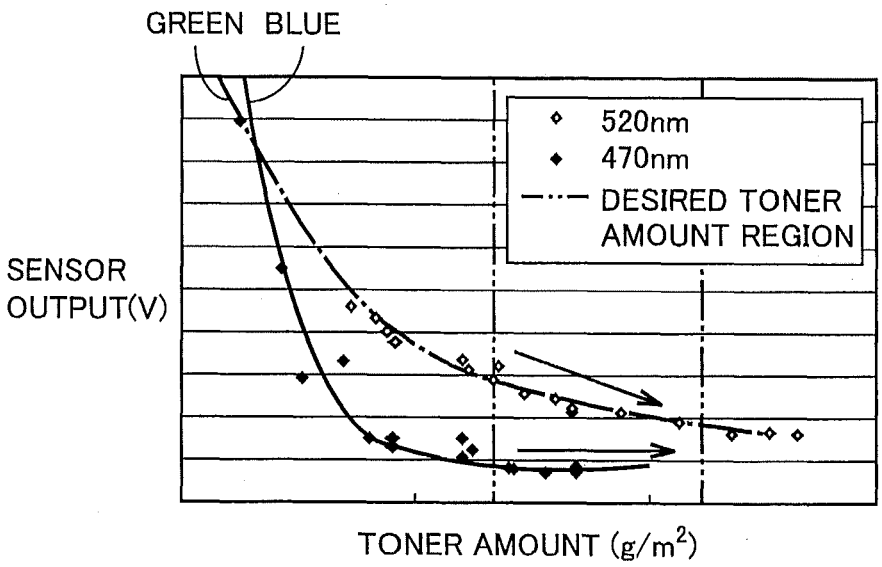
FIG. 13 illustrates the relationship between sensor output and toner amount for a yellow developer according to a first embodiment.

FIG. 13 illustrates the relationship between sensor output and toner amount for a yellow developer according to the first embodiment.

Referring to FIG. 13, a yellow developer is a developer in which toner particles including yellow pigments are dispersed in a carrier liquid. For the yellow developer, when a blue LED (peak wavelength of 470 nm) with high absorbance with a yellow pigment is used as described above, a change in sensor output with respect to the toner amount is extremely large in a toner amount region smaller than the desired toner amount region, and the sensor output decreases almost to the limit, as can be seen from the toner amount detection result for the yellow developer. Therefore, there is almost no change in sensor output with respect to the toner amount in the desired toner amount region. That is, because of too high detection sensitivity, detection sensitivity cannot be obtained in the desired toner amount region.

On the other hand, when a green LED (peak wavelength of 520 nm) is used, there is an appropriate change in sensor output with respect to the toner amount in the desired toner amount region, resulting in appropriate detection sensitivity.

It is therefore possible to set the toner amount detection sensor with appropriate detection sensitivity by calculating a developer characteristic value, calculating a sensor intensity in the wavelength region in which the developer characteristic value falls within a predetermined range, and then selecting a light-emitting unit with a high sensor intensity in the wavelength region within the predetermined range.

(For Cyan (C) Developer)

Referring to FIG. 12(B), the sensor intensities I2 and I3 of a red LED (peak wavelength (632 nm)) are almost zero. Only the sensor intensity I1 has an intensity.

The condition that sensor intensities I2+I3<sensor intensity I1 is also satisfied.

The absorbance with a pigment is moderate, and the effects of Rayleigh scattering and excessive absorption are small, so that sensitivity can be obtained in the desired toner amount region.

The sensor intensities I1 and I3 of a green LED (peak wavelength (520 nm)) are almost zero. The sensor intensity I2 has an intensity.

In this case, although the effects of Rayleigh scattering and excessive absorption are small, absorption by a pigment is low, so that sensitivity cannot be obtained in the desired toner amount region.

The sensor intensities I1 and I3 of a blue LED (peak wavelength (470 nm)) are almost zero. The sensor intensity I2 has an intensity.

In this case, although the effects of Rayleigh scattering and excessive absorption are small, absorption by a pigment is low, so that sensitivity cannot be obtained in the desired toner amount region.

Figure 17:
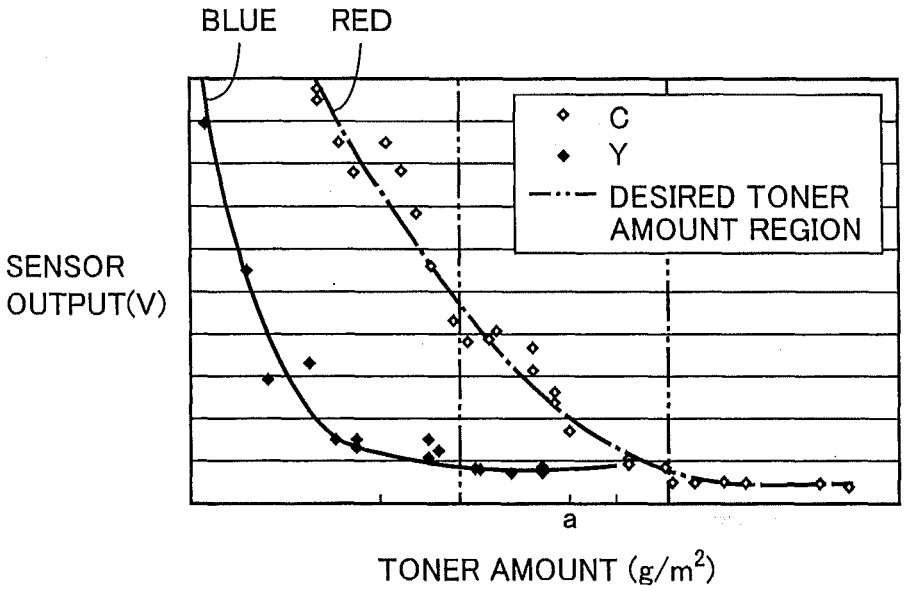
FIG.17 PRIOR ART
FIG. 17 illustrates the result of detecting a toner amount by applying light having a wavelength that is absorbed in the pigment for each of cyan and yellow developers.

For the cyan (C) developer, therefore, a red LED is used as a light-emitting unit to enable detection of the desired toner amount region with more appropriate detection sensitivity. This is as described with reference to FIG. 17.

It is therefore possible to set the toner amount detection sensor with appropriate detection sensitivity by calculating a developer characteristic value, calculating a sensor intensity in a wavelength region in which the developer characteristic value falls within a predetermined range, and then selecting a light-emitting unit with a high sensor intensity in the wavelength region within the predetermined range.

In this example, the yellow developer and the cyan developer have been described. The same can be applied to other developers such as a magenta developer and a black developer.

Second Embodiment

In the first embodiment, for the yellow developer, a green LED (490 to 562 nm (peak wavelength 520 nm)) is used for a photodiode having light reception sensitivity in 400 to 740 nm to detect a desired toner amount region with appropriate detection sensitivity.

As described above, detection sensitivity can be represented as the product of a light emission intensity and light reception sensitivity. The same can be applied even when the characteristic of the light emission intensity of the light-emitting unit and the light reception sensitivity of the light-receiving unit is opposite.

Figure 14:
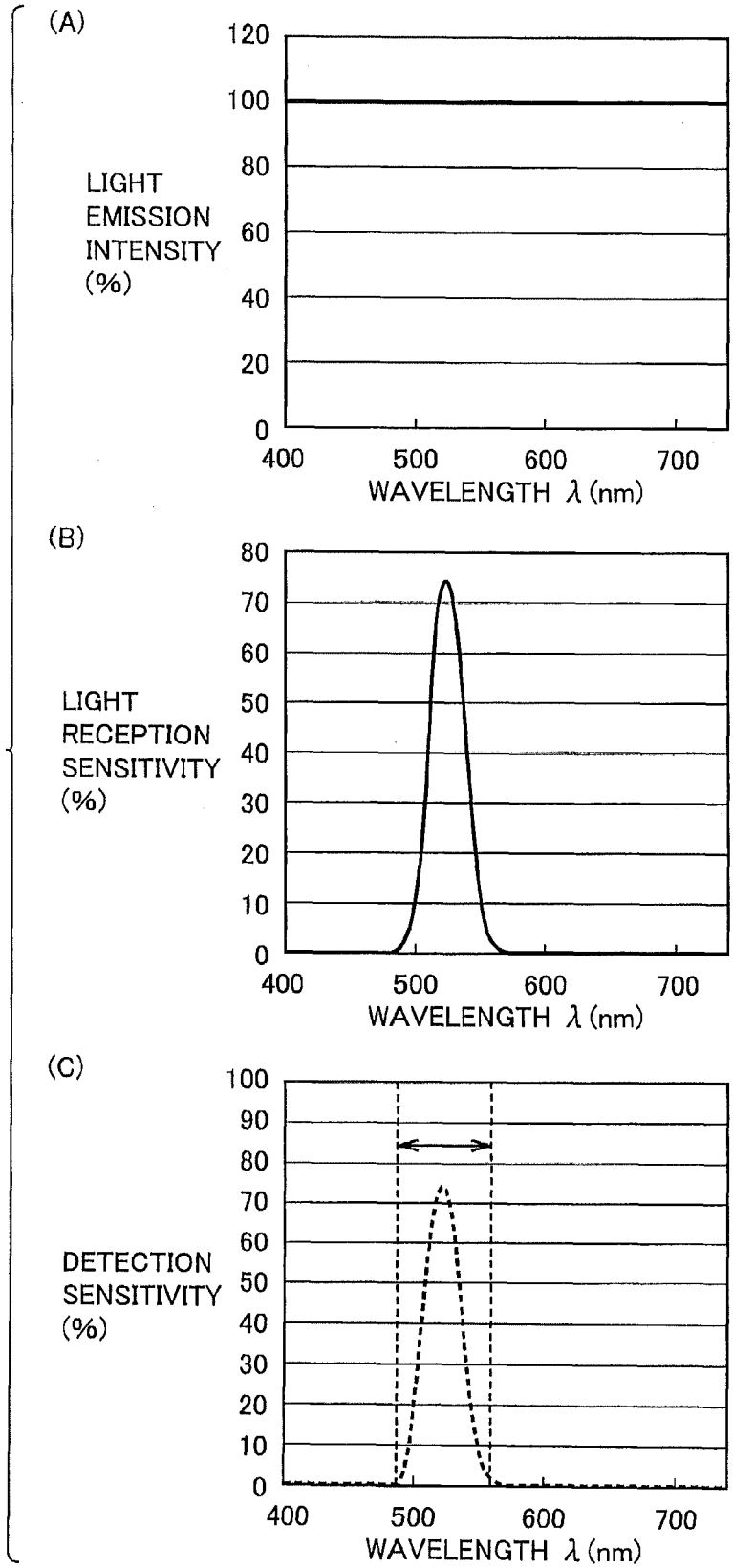
FIG. 14 illustrates the characteristic of the toner amount detection sensor suitable for a yellow developer according to a second embodiment.

FIG. 14 illustrates the characteristics of the toner amount detection sensor suitable for a yellow developer according to the second embodiment.

Referring to FIG. 14(A), here, a white light source having a light emission intensity of 400 to 740 nm is shown.

Referring to FIG. 14(B), here, a photodiode having light reception sensitivity only in a wavelength range of 490 to 562 nm is provided.

Referring to FIG. 14(C), detection sensitivity corresponds to the product of a light emission intensity and light reception sensitivity.

For a yellow developer, a white light source having a light emission intensity of 400 to 740 nm and a photodiode having light reception sensitivity only in 490 to 562 nm can be used to set the toner amount detection sensor having a high sensor intensity for the wavelength region corresponding to the range of $0.02 \leq T \times R \leq 0.06$ as a developer characteristic value.

Accordingly, for the yellow developer, detection sensitivity can be obtained in the desired toner amount region since the absorbance with a pigment is moderate and the effects of Rayleigh scattering and excessive absorption are small.

The wavelength range of light reception sensitivity of light-receiving unit 113 can be restricted, for example, by providing an optical filter such as a long-pass filter or a short-pass filter in the optical path of the photodiode.

Here, the yellow developer has been described. However, the same can be applied to a cyan developer and developers of other colors.

Other Embodiments

As another embodiment, a case where the desired toner amount is on the lower toner amount side than in the first embodiment will be described.

As illustrated in FIG. 13 in the first embodiment, in view of the example in which a blue LED of 470 nm is used as a light source for a yellow (Y) developer, extremely high detection sensitivity is exhibited in the toner amount region smaller than the desired toner amount region.

Therefore, the toner amount a per predetermined area is set to a smaller toner amount such that the desired toner amount region shifts to the lower toner amount side, whereby high detection sensitivity can be obtained in the desired toner amount region even with a toner amount detection sensor having a blue LED of 470 nm as a light source.

On the other hand, in the image forming apparatus, density control is performed so that the image density on a recording medium (paper) is moderate when viewed by the naked eyes. The image density is mainly determined by the amount of pigments on the recording medium.

Therefore, in order to set the toner amount a per predetermined area to a smaller toner amount, it is necessary to increase the pigment content per toner particle. If the pigment content per toner particle is increased, the effect of Rayleigh scattering by a pigment and the effect of absorbance with a pigment are increased with the amount.

Figure 15:
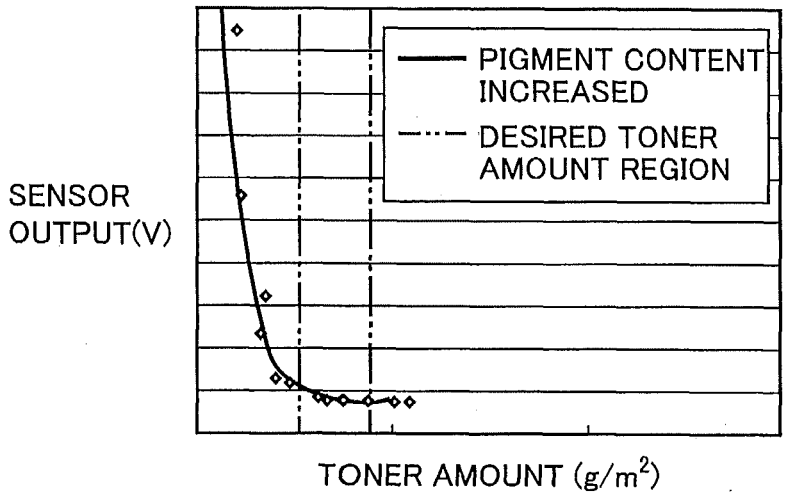
FIG. 15 illustrates the relationship between sensor output and toner amount for a yellow (Y) developer with a pigment content increased per toner particle.

FIG. 15 illustrates the relationship between sensor output and toner amount for a yellow (Y) developer with a pigment content increased per toner particle.

Referring to FIG. 15, the region shown by the dashed two-dotted lines indicates the desired toner amount region to be detected. Here, a smaller toner amount is set.

The sensor output for a yellow (Y) developer with a pigment content increased is shown.

Even when the desired toner amount region is set to a smaller toner amount, because of the increased pigment content, the quantity of light received by light-receiving unit 113 is reduced due the effects of Rayleigh scattering and absorption by a pigment. As a result, it is understood that detection sensitivity cannot be obtained in the desired toner amount region.

Figure 16:
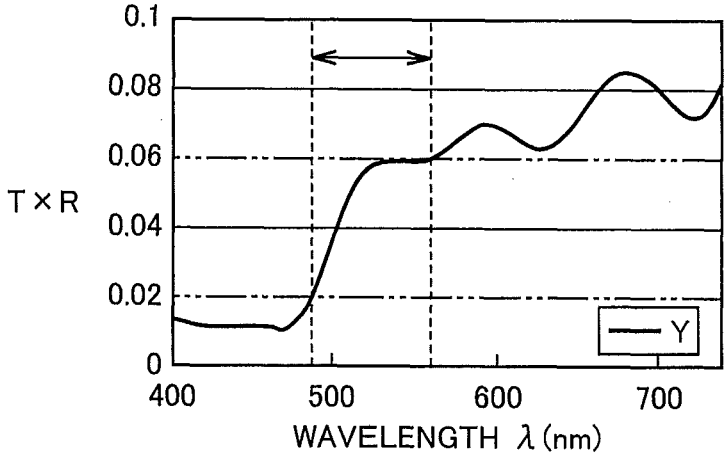
FIG. 16 illustrates the wavelength characteristic of a developer characteristic value (transmittance T×reflectivity R) of a yellow (Y) developer with a pigment content increased per toner particle.

FIG. 16 illustrates the wavelength characteristic of the developer characteristic value (transmittance T×reflectivity R) of a yellow (Y) developer with a pigment content increased per toner particle.

Referring to FIG. 16, although the pigment content per toner particle is increased, since the toner amount a per predetermined area is set at a smaller toner amount, the number of pigments in the diluted developer remains the same as in the first embodiment. The wavelength characteristic of the developer characteristic value (transmittance T×reflectivity R) is also almost the same as in the first embodiment.

Therefore, the sensor wavelength characteristic that can achieve suitable detection sensitivity in the desired toner amount region can be selected in accordance with the same method for a developer having a different pigment content per toner particle. That is, an appropriate toner amount detection sensor can be set.

The same can be applied not only to a developer different in pigment content per toner particle but also to a developer different in, for example, particle size distribution or color (wavelength distribution of absorbance) of the developer.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A wet-type image forming apparatus comprising:

an image carrier;

a toner developer layer formed of toner and a carrier liquid carried on said image carrier; and a toner amount detection unit for detecting a toner amount of the toner developer layer carried on said image carrier, said toner amount detection unit including:

a light-emitting unit for emitting light to the toner developer layer carried on said image carrier and a light-receiving unit for receiving reflected light when light is emitted from said light-emitting unit to the toner developer layer carried on said image carrier, wherein wavelength characteristics of a light emission intensity of said light-emitting unit and a light reception sensitivity of said light-receiving unit are set such that an intensity of detection sensitivity of said toner amount detection unit in accordance with a product of a light emission intensity of said light-emitting unit and a light reception sensitivity of said light-receiving unit is greater in a wavelength region in which a characteristic value based on a product of a transmittance of the toner developer layer and a reflectivity of said image carrier as a reference for a light emission wavelength is included in a predetermined range, than in other wavelength regions.

2. The wet-type image forming apparatus according to claim 1, wherein said wavelength region included in a predetermined range corresponds to the wavelength region in which said characteristic value is included in a range of 0.02 to 0.06.

3. The wet-type image forming apparatus according to claim 2, wherein the wavelength characteristics of the light emission intensity of said light-emitting unit and the light reception sensitivity of said light-receiving unit are set such that the intensity of detection sensitivity of said toner amount detection unit in the wavelength region in which said characteristic value is included in the range of 0.02 to 0.06 is higher than the intensity of detection sensitivity in the wavelength region in which said characteristic value is included in a range lower than 0.02 or said characteristic value is included in a range greater than 0.06.

4. The wet-type image forming apparatus according to claim 3, wherein the wavelength characteristics of the light emission intensity of said light-emitting unit and the light reception sensitivity of said light-receiving unit are set such that the intensity of detection sensitivity of said toner amount detection unit in the wavelength region in which said characteristic value is included in the range of 0.02 to 0.06 is greater than the intensity of the sum of detection sensitivity in said other wavelength regions.

5. The wet-type image forming apparatus according to claim 1, wherein the reflectivity of said image carrier is a reflectivity based on specular reflection.

* * * * *